United States Patent [19]

Hendricks

[11] Patent Number: 4,542,899

[45] Date of Patent: Sep. 24, 1985

[54] EXERCISE DEVICE

[76] Inventor: Byron J. Hendricks, 10038 Giovane Rd., El Monte, Calif. 91733

[21] Appl. No.: 574,274

[22] Filed: Jan. 26, 1984

[51] Int. Cl.[4] ..... A63B 21/06

[52] U.S. Cl. ..... 272/118; 272/134; 272/DIG. 4; 272/143

[58] Field of Search ..... 272/DIG. 4, 134, 143, 272/118, 93, 116, 117

[56] References Cited

U.S. PATENT DOCUMENTS

| | | | |
|---|---|---|---|
| 3,820,782 | 6/1974 | Salkeld | 272/134 |
| 3,905,599 | 9/1975 | Mazman | 272/81 |
| 4,470,596 | 9/1984 | Desiderio | 272/118 |

OTHER PUBLICATIONS

Brochure, Nautilus Sports/Medical Industries, Nautilus, 1980.

Brochure, Gym Equipment International, Inc., PRO AM Circuit Trainer.

Brochure, Kidde, Inc., Universal Physical Conditioning Equipment, 1981–1982, Catalog.

Brochure, Kidde, Inc., Universal Physical Conditioning Equipment, 1983–1984, Catalog.

Brochure, Kidde, Inc., Power-Pak 400.

Brochure, Kidde, Inc., Power-Pak 300.

Brochure, Gym Equipment International, Inc., Space Saver GYM-IN-ONE.

*Primary Examiner*—Richard J. Apley
*Assistant Examiner*—James Prizant
*Attorney, Agent, or Firm*—Christie, Parker & Hale

[57] ABSTRACT

An exercise device is provided which is useful for a wide variety of exercises. The exercise device includes a frame and a plurality of weights stacked one above the other on the frame. A lift assembly is slidably mounted on the frame for vertical up and down movement along the height of the frame. The lift assembly includes a cage open at the top and bottom having a sufficient horizontal cross section so that the cage can be moved up and down around the outside of the stack of weights. A first elongated lifting arm extends horizontally along one side of the cage and is mounted to the cage for horizontal sliding movement along the side of the cage. A second elongated lifting arm extends horizontally along the opposite side of the cage and is mounted to the cage for horizontal sliding movement along the side of the cage. Means are on the frame for coupling a selected number of the weights to the lift assembly to thereby provide a resistance force to vertical upward movement of the lift assembly. Additionally, means are on the frame for providing a force opposite to the resistance force when the first and second elongated arms are moved horizontally in the same direction along the sides of the cage.

35 Claims, 5 Drawing Figures

20
58
12
10
132
130
18
82
90
88
80
12
18b
18
10
18
18c
18b
68
52
18b
22
18a
34
34
30
34
32
28
48
28
50
30
32
32b
32
38
30
60
34
34
32a
28
46
120
104
16
14
12
78
56
22
112
110
14
12
10
16
130
126
128
14

12
20
94
102
92
92
100
18c
100
90
88
10
80
18c
44
96
96
32b
32a
40
40
30
98
30
42
38
42
32a 20
116
12
10
114
114
18c
90
88
80
18c
110
120
124
106
104
108
125
130
122
118
126
128
112
14

EXERCISE DEVICE

FIELD OF THE INVENTION

This invention is related generally to exercise devices or machines, and more particularly to an exercise device useful for a wide variety of exercises.

BACKGROUND OF THE INVENTION

There are many exercise devices of various designs presently available to a person who desires to exercise.

Commonly, such exercise devices include a movable lever arm and weights that can be connected to the lever arm to provide a resistance to its movement. The resistance to movement of the lever arm is overcome by a force exerted on the lever arm by a person using the device for exercise.

A drawback to such devices is that the direction of the force exerted by the person doing the exercise is defined by the motion of the lever arm, which is fixed, depending upon the design of the particular exercise device being used. Therefore, in order to move the lever arm in different directions or angles with respect to the body so that different muscles can be exercised, the person must reposition himself at a different angle with respect to the device for each exercise. Such repositioning can be inconvenient depending on the position required for a given exercise. Furthermore, it has been found that all of the exercises in an exercise program cannot be done on a single such exercise device. For example, when the lever arm is designed to be moved by a pushing motion, exercises that require a pulling motion cannot be done on that device. Conversely, when the lever arm (or a pulley and cable arrangement) on the device is designed to be pulled, this device cannot be used for exercises that require a pushing motion.

Because such presently known exercise devices can accommodate only a portion of the motions required for a full exercise program, generally a plurality of such devices, each having a different design, must be used.

Buying a plurality of separate exercise devices, each designed for a different portion of an exercise program, can be very expensive. Additionally, when several exercise devices are required, they may take up more space than is available or can be afforded. For example, space may not be available in a house to accommodate more than one exercise device.

There is, therefore, a need in the art for a single exercise device that can accommodate a substantial portion of the motions required for a full exercise program.

SUMMARY OF THE INVENTION

An exercise device is provided in accordance with practice of this invention which can accommodate a substantial portion of the motions required for a full exercise program.

The exercise device comprises a frame and a lift assembly slidably mounted on the frame for generally vertical up and down movement along the height of the frame. At least one elongated arm is slidably mounted on the lift assembly capable of horizontal sliding movement along the lift assembly. Resistance means are interconnected with the frame for providing a resistance force against vertical upward movement of the lift assembly. Means are connected between such an elongated arm and the frame for providing a force opposite to the resistance force when the elongated arm is moved horizontally in either direction along the lift assembly.

The lift assembly can be raised against the resistance force during exercise by providing a solely horizontal force on the arm to move it horizontally, or by providing a solely vertical force on the arm. Additionally, the lift assembly can be raised by providing a force on the arm in the vertical plane in which the arm is located at any angle between an upward vertical force and a horizontal force.

Because the force provided on the arm during exercise can be in any of the directions described above, exercises that require either pushing or pulling motions at any angle within the vertical plane of the arm can be accommodated. Therefore, a substantially wider variety of exercises can be performed on the exercise device of this invention than can be performed on any single known prior art device.

BRIEF DESCRIPTION OF THE DRAWINGS

These are other features, aspects, and advantages of the present invention will be more fully understood when considered with respect to the following detailed description, appended claims, and accompanying drawings, wherein:

DETAILED DESCRIPTION

Figure 1:
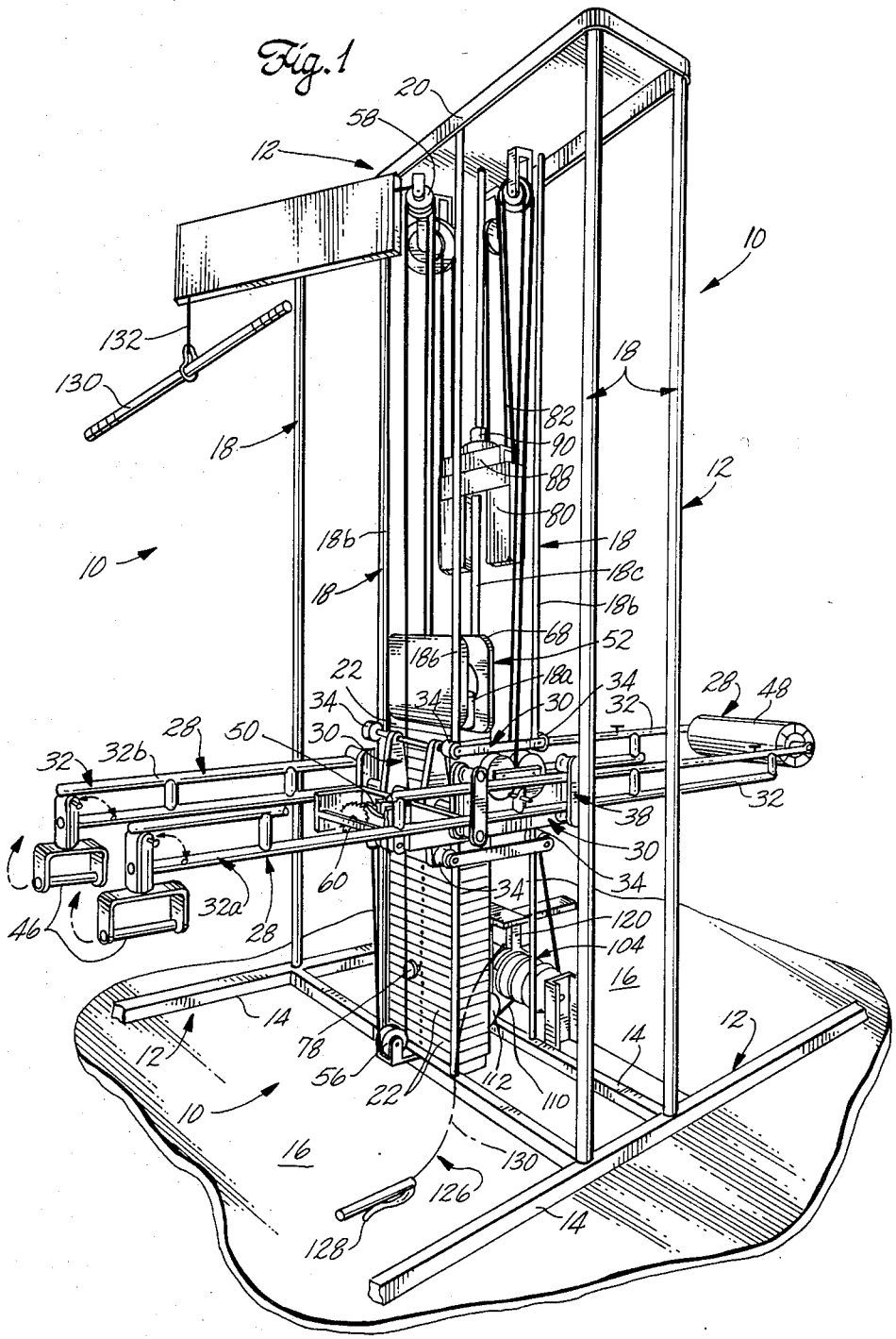
FIG. 1 is a semi-schematic, perspective, fragmentary view of an exemplary embodiment of an exercise device provided in accordance with practice of principles of this invention.

Referring to FIG. 1, there is shown a semi-schematic, perspective view of a preferred embodiment of an exercise device 10 provided in accordance with practice of principles of this invention.

The exercise device includes a vertically standing frame 12 on which the components of the device are mounted. The frame includes a base section 14 mounted on a horizontally extending surface 16 and a plurality of frame members 18 which extend vertically upward between the base section 14 and a top section 20 which supports the members 18 at their tops.

In the illustrated embodiment, the frame members 18 are tubular in shape, but frame members having other shapes can be used, if desired.

Figure 2:
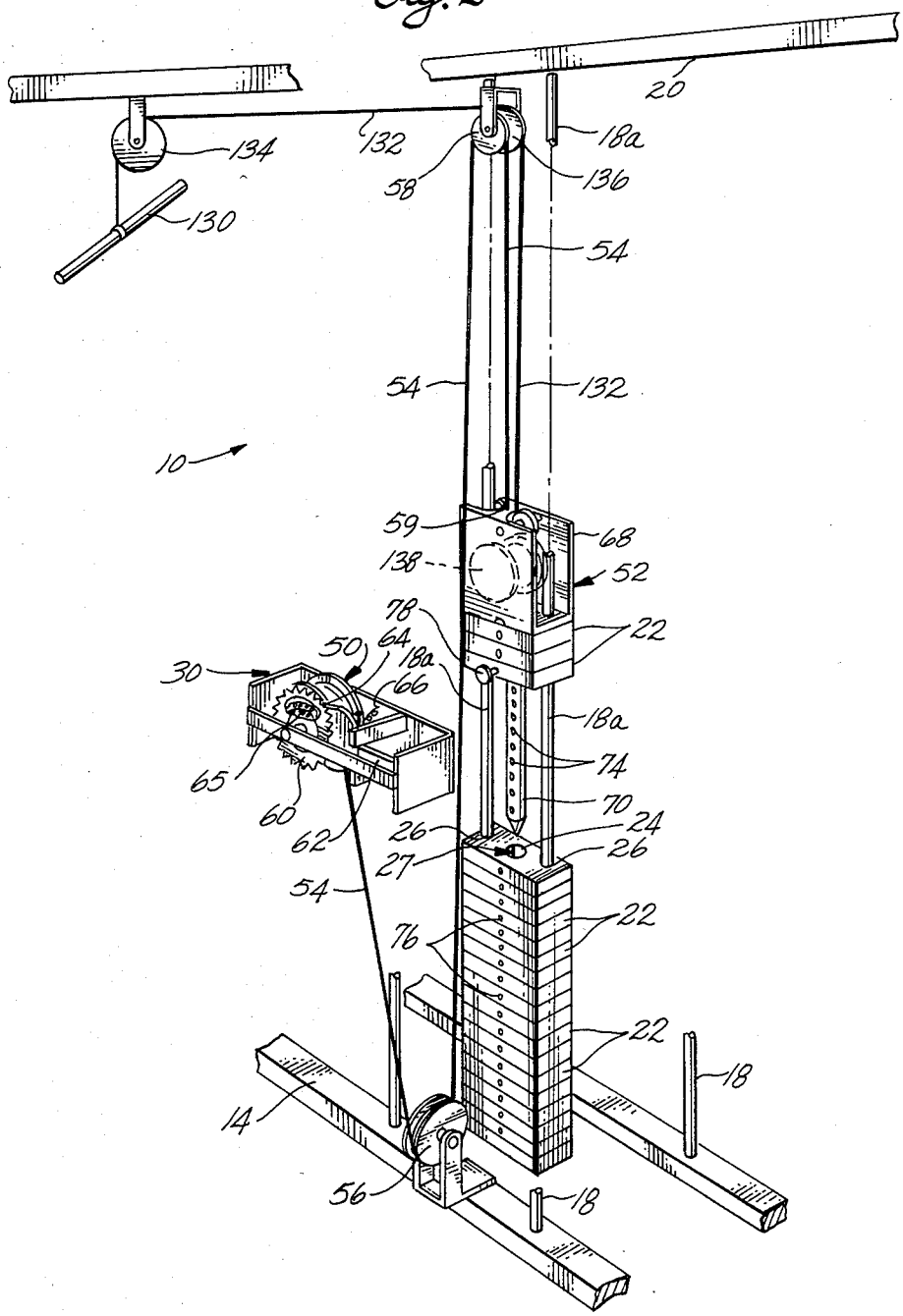
FIG. 2 is a semi-schematic, enlarged, perspective, fragmentary view of a portion of the components of the device of FIG. 1, including a stack of weights and a lifting block assembly that can be coupled to the weights.

Referring to FIG. 2, in addition to FIG. 1, a plurality of flat weights 22 stacked one on top of the other are slidably mounted on the frame for vertical up and down movement. As is described in detail below, the weights provide a resistance to the force exerted by a person using the device 10 for exercise.

Although weights provide the resistance to the force exerted during exercise in the illustrated embodiment of the device 10, it is contemplated that other resistance means, such as hydraulic cylinders or springs, could be used, if desired.

The weights 22 are similar to those used on various prior art devices, and such weights are described in detail, for example, in U.S. Pat. No. 3,905,599 which is incorporated herein by this reference.

Three horizontally spaced-apart vertical holes (best seen in FIG. 2) are in each weight 22; a hole 24 through about its center and a pair of holes 26, one of which is on each side on the center hole. The weights are slidably mounted on the frame for vertical up and down movement on a pair of frame members or guide rods 18*a* which extend from the frame base 14, to its top 20, through the holes 26. The center holes 24 of the weights are in registry with each other when the weights are on the guide rods 18*a* and form an elongated vertical cavity 27 within the stack of weights.

A lift assembly, generally shown at 28 of FIG. 1, is slidably mounted on the frame 12 for vertical up and down movement along the height of the frame. As is described below in greater detail, the lift assembly is provided for lifting a selected number of the weights 22 as it is raised during exercise.

The lift assembly 28 comprises a cage, generally shown at 30, and a pair of elongated horizontally extending lifting arms 32 mounted on the cage. The lift assembly rides up and down on the frame by means of eight wheels 34, one of which is mounted on each corner of the cage 30. The wheels 34 ride on four vertically extending frame members 18*b*. The basic frame structure of the cage 30 and the positioning of the wheels 34 thereon can best be seen by referring to FIG. 3.

The cage 30 is open at its top and bottom and has a sufficient horizontal cross section so that it is free to move up and down around the outside of the stack of weights 22. As is described below in greater detail, this enables the lift assembly 28 to be positioned on the frame at any elevation from its bottom to its top.

Figure 4:
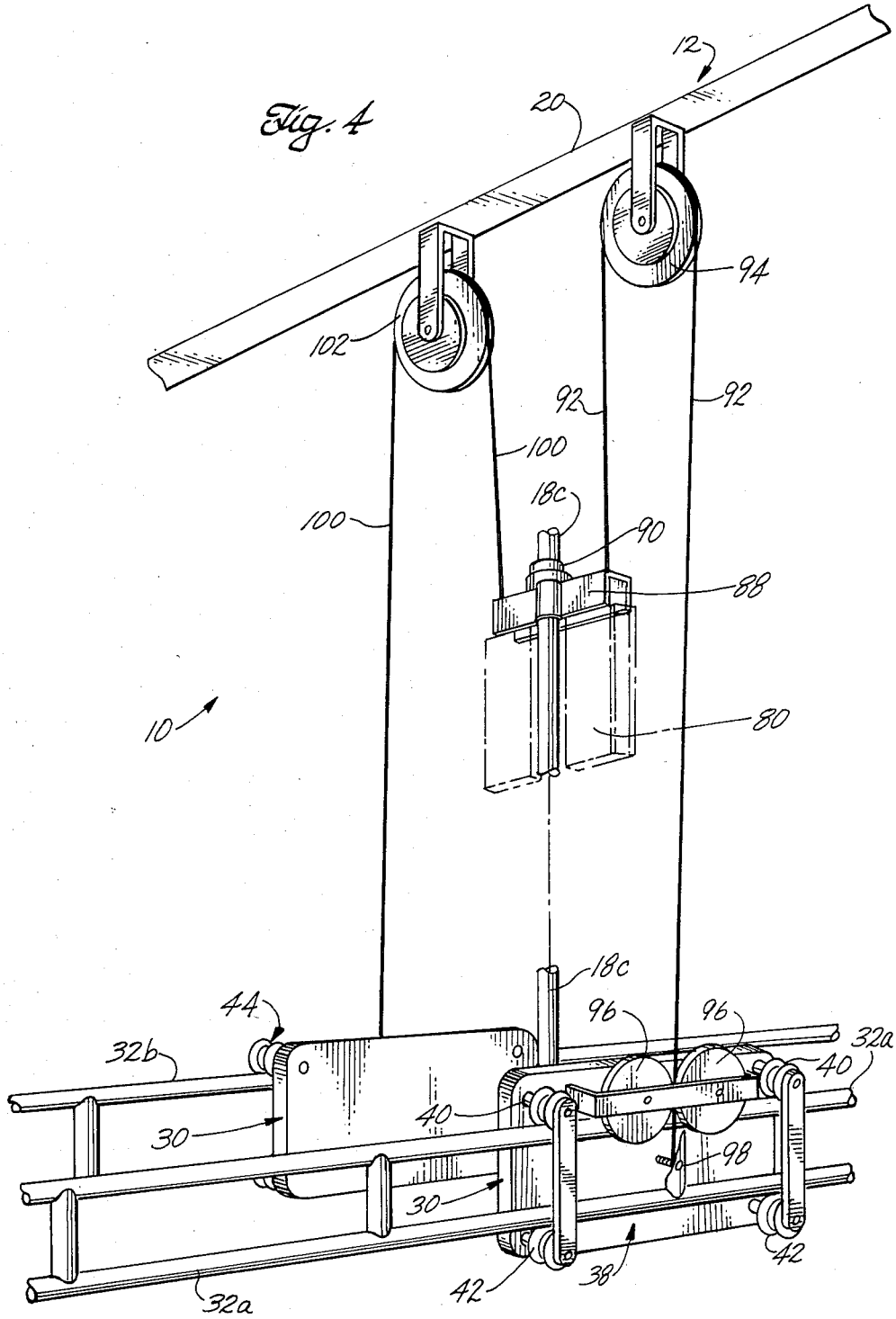
FIG. 4 is a semi-schematic, enlarged, perspective view of yet other components of the device of FIG. 1, including a pair of lifting arms and a stop block assembly which act together to raise a lift assembly coupled to the weights and lifting block assembly.

Referring particularly to FIGS. 1 and 4, the elongated lifting arm 32*a* extends horizontally along one side of the cage 30, and the elongated lifting arm 32*b* extends horizontally along the opposite side of the cage. The lifting arms 32*a* and 32*b* are parallel to each other and are mounted for horizontal sliding movement along their respective sides of the cage. The lifting arm 32*a* rides in a roller assembly 38 (best seen in FIG. 4) which is attached to the cage 30 and has four rollers mounted thereon. The top surface of the arm 32*a* rides on two horizontally spaced apart, upper rollers 40, and its bottom surface rides on two horizontally spaced apart lower rollers 42. The lifting arm 32*b* rides in a roller assembly 44 (not fully shown) which is identical to the roller assembly 38.

In the illustrated embodiment, a handle 46 is attached to one end of each of the arms 32*a* and 32*b*, and an exercise pad 48 is connected between the arms at the other end. For purpose of exposition herein, the side of the exercise device on which the handles 46 are attached is referred to as the front side, and the side of the device on which the exercise pad is attached is referred to as the back side.

Both of the handles 46 can be locked in position facing down, as shown in FIG. 1, or can be locked in position facing horizontally away from the frame 12, as desired. Handles having other designs can also be used. Furthermore, although an exercise pad 48 is provided, connecting the arms 32*a* and 32*b* together, in other embodiments of the device 10, no such pad is provided.

Means are on the frame 12 for coupling and uncoupling a selected number of the weights 22 to the lift assembly 28 to provide a resistance force to vertical upward movement of the assembly.

Turning to FIGS. 1 and 2, in the illustrated embodiment the coupling and uncoupling means includes a rotatable spool 50 mounted on a front section of lift assembly cage 30 and a lifting block assembly, generally shown at 52, that is slidably mounted on the frame 12 and can be connected to a selected number of the weights 22. A lift cable 54 is connected between the spool 50 and the top of the lifting block assembly 52.

In the illustrated embodiment, the lift cable 54 extends downwardly from the spool 50 and through a pulley 56 mounted on the base of the frame. From the spool 56 the cable 54 extends upwardly through a pulley 58 mounted on the frame section 20 and extends downwardly from the pulley 58 to a connection 59 on the lifting block assembly 52.

Locking means are provided to lock the pulley 50 against rotation. In the illustrated embodiment, the locking means (best seen in FIG. 2) includes a circular gear 60 mounted on the spool 50 for rotation with the spool, and a locking arm 62 movably mounted on a section of the cage 30 adjacent the spool. The locking arm has a plurality of gear teeth 64 on its end adjacent the gear 60 for mating with the gear and can be moved horizontally toward and away from the frame 12. For example, the locking arm can be moved horizontally from a first position, nearer the frame 12 where the teeth 64 are engaged with the gear 60, to a second position, away from the frame where the teeth 64 are disengaged from the gear. When the locking arm 62 is in its engaged or first position, the spool 50 is locked against rotation, i.e., the spool cannot rotate. When the arm 62 is in its disengaged or second position, the spool is free to rotate.

A spring 66 is connected between the cage 30 and the locking arm 62 to bias the locking arm into its first or engaged position. Additionally, a spring assembly 65 is contained within the spool 50 for rotating the spool when the locking arm is in its second or disengaged position. As is described below in greater detail, the rotation of the spool 50 provided by the spring assembly 65 is for taking up slack in the cable 54 when the lift assembly 28 (and the associated cage 30 and spool 50) is lowered and the locking arm 62 is disengaged from the spool.

The lifting block assembly 52 comprises a lift block 68 and an elongated selector rod 70 (shown in FIG. 2), which is fixed to the bottom of the lift block and extends downwardly therefrom. The selector rod 70 can be moved into and out from the cavity 27 in the stack of weights 22 formed by the center holes 24. The rod 70 has a plurality of vertically spaced-apart, horizontal holes 74 through it. Each one of the holes 74 registers with horizontal hole 76 in an associated weight when the weights are stacked together and the lift block 68 is resting on the top of the weights, as is shown in FIG. 1.

The number of weights to be lifted, i.e., the number of weights that is desired to provide the resistance force to exercise, is selected by inserting a selector pin 78 through one of the holes 76 and into the associated hole 74 in the selector rod 70. When the selector pin 78 is in position through the hole in the weight and an associated selector rod hole, and the lifting block assembly 52 is raised, as is shown in FIG. 2, the selected number of weights, i.e., the weights above the pin, are lifted.

When the locking arm 62 is in its engaged position, as is shown in FIG. 2, the spool 50 is not free to rotate, thereby fixing the length of that portion of the cable 54 connected between the spool 50 and the lifting block 68. This couples both the weights above the selector pin 78 and the lifting block assembly 52 to the lift assembly 28. As is described below in greater detail, when the weights 22 and lifting block assembly 52 are coupled to the lift assembly 28, upward vertical movement of the lift assembly causes the lifting block and weights connected thereto to move upwardly, thereby providing a resistance force to the exercise being conducted on the device 10.

Figure 3:
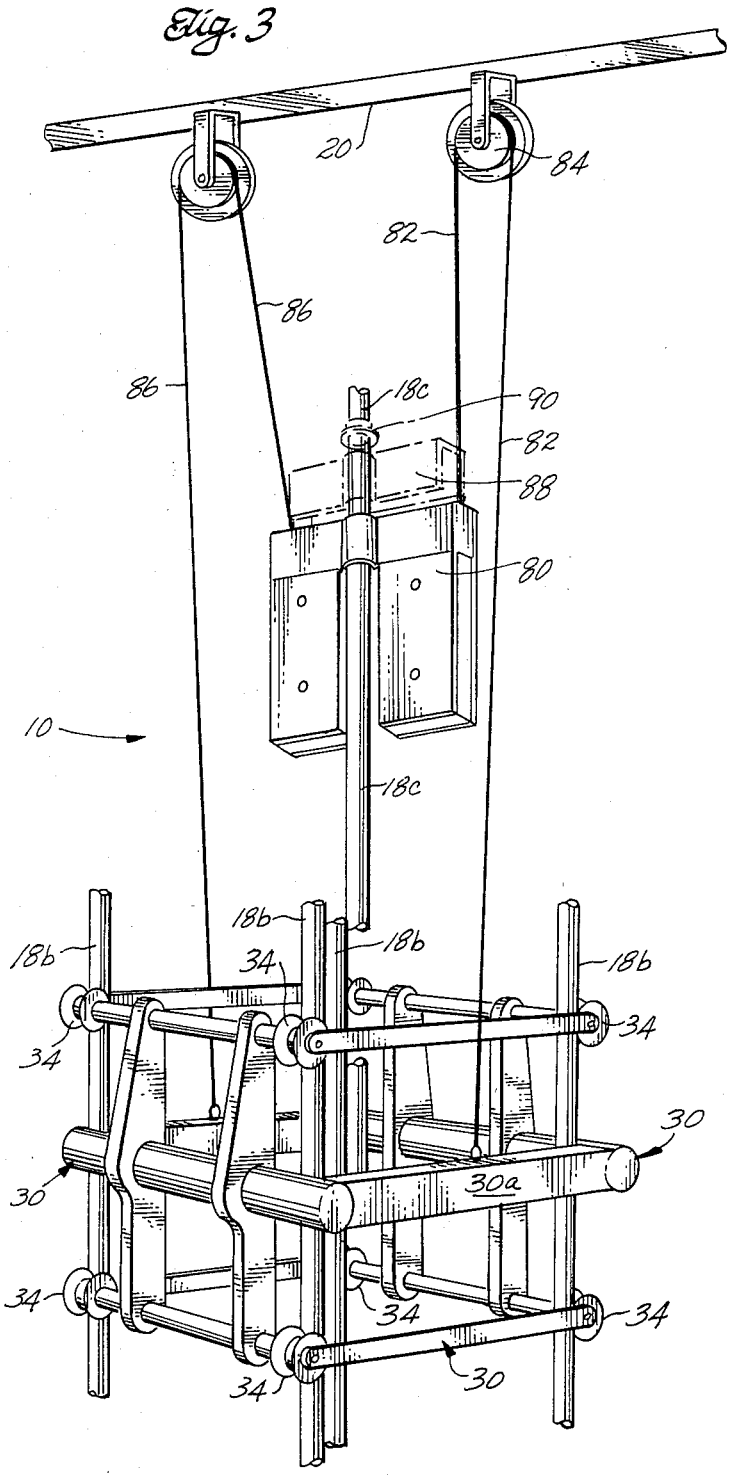
FIG. 3 is a semi-schematic, enlarged, perspective, fragmentary view of other components of the device of FIG. 1, including a counterbalancing weight and a portion of a lift assembly used to lift the weights and lifting block assembly shown in FIG. 2.

Referring particularly to FIGS. 1 and 3, a weight 80 is mounted on the frame 12 to counterbalance the weight of the lift assembly 28. In a preferred embodiment of the device 10, the weight 80 provides a weight sufficient so that substantially the entire resistance force to vertical upward movement of the lift assembly is provided by the selected number of weights when the selected number of weights are coupled to the lift assembly. The weight 80 rides on a vertical frame member 18*c* which extends from the base 14 to the top 20 of the frame. A first cable 82 is attached on one end to one side of the top of the weight 80, extends upwardly through a pulley 84 mounted at the top of the frame, and is connected at its other end to a side member 30*a* of the cage 30. A second cable 86 is similarly attached on one end to the opposite side of the top of the weight 80 and on its other end to the side of the cage 30 opposite from the cable 82.

As is described above, the first and second lifting arms 32*a* and 32*b*, respectively, can be moved horizontally along the sides of the cage. A key feature provided by the exercise device 10 of this invention is that such horizontal movement of the arms raises the lift assembly vertically.

Figure 5:
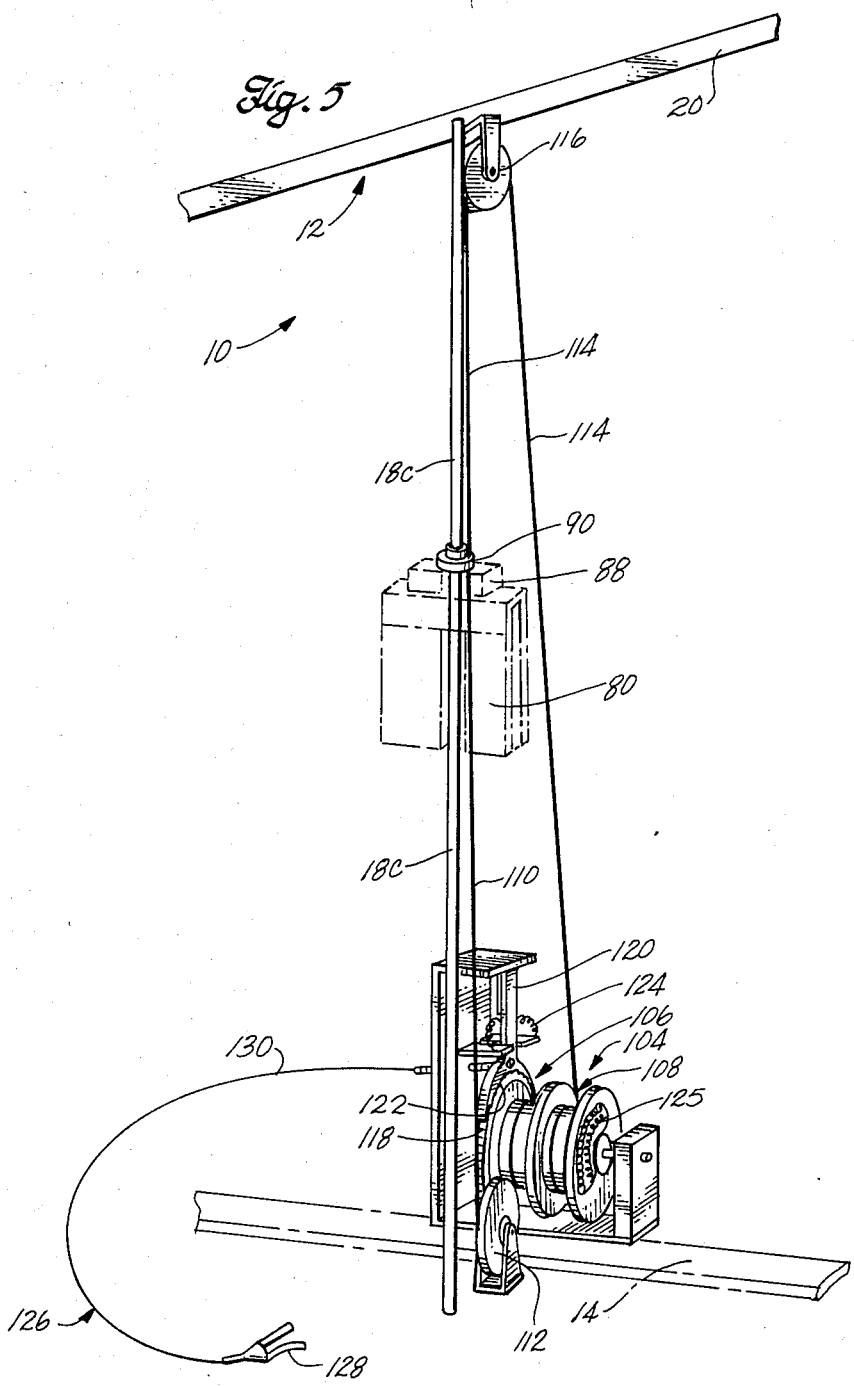
FIG. 5 is a semi-schematic, enlarged, perspective, fragmentary view of yet other components of the device of FIG. 1, including a locking mechanism and an associated stop which acts in combination with the lifting arms and stop block to cause the lift assembly to raise when the arms are moved horizontally along the lift assembly.

Referring particularly to FIGS. 1, 4, and 5, components of the exercise device 10, which act in combination with the arms 32*a* and 32*b* to provide upward movement of the lift assembly in response to horizontal movement of the arms, can be understood.

The first such device is a stop block 88 which rides above the weight 80 on the frame member 18*c*. The second such device is a stop 90, which also rides on the frame member 18*c* and is above the stop block 88. The stop block 88, stop 90, and weight 80 are not connected together.

Referring particularly to FIG. 4, the stop block 88 is connected to the arms 32 by means of a cable and pulley arrangement. A first cable 92 is attached on one end to one side of the stop block 88 and extends upwardly over a pulley 94 mounted to the frame top section 20. The cable 92 extends downwardly from the pulley 94 between a pair of guide rollers 96 mounted on the side of the cage 30 adjacent the arm 32*a*. The end of the cable 92 that extends from between the rollers 96 is attached at a connection 98 to the arm 32*a*. A second cable 100 is similarly attached between the opposite side of the stop block 88 and the arm 32*b* by means of a pulley 102 and rollers (not shown) on the side of the cage 30 adjacent the arm 32*b*. The guide rollers provide the means by which the cables 92 and 100 move horizontally along the sides of the cage as the arms 32*a* and 32*b* are moved horizontally.

Referring particularly to FIG. 5, the stop 90 is shown locked in position in the frame member 18*c*. As is described below in greater detail, when the stop 90 is locked on the frame member 18*c* against upward vertical movement, horizontal movement of the arms 32 pulls the stop block 88 up against the stop which, in turn, causes the lift assembly to rise.

The mechanism provided in accordance with this invention for locking the stop 90 on the member 18*c* is made up of a cable and spool arrangement. A spool 104 that includes a pair of horizontally spaced spool sections 106 and 108 is rotatably mounted on the frame base 14. A lower cable 110 is connected on one end to the stop 90, extends downwardly from the stop through a pulley 112 on the frame base, and is connected on its other end to the spool section 106 of the spool 104. An upper cable 114 is connected on one end to the stop, extends upwardly from the stop through a pulley 116 mounted on the top section 20 of the frame 12, and is connected on its other end to the spool section 108.

A locking mechanism is provided to lock the spool 104 against rotation. The locking mechanism for the spool 104 is similar to the locking mechanism described above for locking the spool 50. A circular gear 118 is mounted on one end of the spool 104 for rotation with the spool. A locking arm 120, which has a plurality of teeth 122 on its end adjacent the gear 118 for mating with the gear, is mounted on the frame for horizontal movement. The arm 120 can be moved from a first position where the teeth 122 are engaged with the gear 118, thereby locking the spool 104 against rotation, to a second position where the teeth 122 are disengaged from the spool 104, thereby freeing it to rotate.

A spring 124 is connected between the frame 12 and the locking arm 120 for biasing the locking arm into its first or engaged position. A pull cable assembly 126, which is similar to a bicycle hand brake, is connected on one end to the locking arm 120 for pulling the locking arm to its second or disengaged position against the force exerted by the spring 124. The cable assembly includes a hand grip 128 that, when squeezed, pulls the cable 130 of the assembly 126 for disengaging the locking arm 120 from the gear 118 and, when released, allows the arm to be pulled back into its engaged position by the spring 124.

A spring assembly 125 is contained within the spool 104 for rotating the spool when the locking arm is in its disengaged position. As is described below in greater detail, the spring in the spool 104 operates to rotate the spool in a direction to take up the slack in the cables 110 and 114 as the stop is moved up or down on the frame member 18*c*.

Turning again to FIG. 2, in the illustrated embodiment of the exercise device 10, a pull bar 130 is connected to the exercise device by means of a cable 132. The cable 132 is connected on one end to the bar 130, extends through a pair of pulleys 134 and 136 on the top of the frame 12, and is connected on its other end to a spool 138 (shown in dashed lines) that is rotatably mounted in the lifting block 68. A spring assembly (not shown) is contained within the spool 138 for rotating the spool to take up slack in the cable 132 when the pull bar is not being used and the lift assembly is being raised and lowered on the frame. As is described below in greater detail, the pull bar and cable arrangement enables a person doing exercises to exert a force opposite to the resistance force provided by the weights 22 when the lifting block is uncoupled from the lift assembly 28, i.e., when the locking arm 62 is disengaged from the spool 50.

OPERATION

The first operation to be performed by a person desiring to use the exercise device 10 is to position the lift assembly 28 at a desired starting elevation on the frame 12 for the particular exercise to be performed.

As is described below in detail, to move the lift assembly 28 to a new starting elevation, it must be uncoupled from the weights 22 and the stop 90 must be freed to slide on the frame member 18*c*.

To uncouple the weights 22 from the lift assembly, the locking arm 62 is pulled away from the frame 12 against the force of the spring 66. This disengages the teeth 64 on the arm 62 from the gear 60 on the spool 50. When the arm is disengaged, the spool is free to rotate. If desired, the spool can be pinned in its disengaged position.

To free the stop 90 for sliding movement up or down on the frame member 18*c*, the locking arm 120 is moved against the force of the spring 124 so that the gear teeth 122 on the locking arm are disengaged from the gear 118 on the spool 104. The locking arm can be conveniently disengaged from the spool 104 by using the pull cable assembly 126. When the hand grip 128 of the pull cable assembly 126 is squeezed, the pull cable 130 moves toward the hand grip, thereby pulling the arm 120 horizontally out of engagement with the gear 118. When the arm 120 is in its second or disengaged position, the spool 104, and thus the spool sections 106 and 108 of the spool 104, are free to rotate.

Once both of the arms 62 and 120 are in their disengaged positions, the lift assembly can be moved either up or down, as desired, to its new starting position. The lift assembly 28 can be moved up simply by exerting an upward force on the assembly. As the assembly moves up, the cable 54 unwinds from the spool 50, thereby lengthening that portion of the cable that extends from the spool 50 to the pulley 56. Additionally, during upward movement of the lift assembly, both the weight 80 and the stop block 88 slide down the frame member 18*c*. The spool 104 rotates by means of the spring 125 contained therein in a direction to wind the cable 110 around the spool section 106 of the spool 104. As the cable 110 winds around the spool section 106, it pulls the stop 90 down tightly against the top of the stop block 88. Additionally, as the stop moves down, the cable 114 is unwound from the spool section 108.

When the lift assembly is at its desired elevation, for example, at the elevation shown in FIG. 1, the locking arm 62 is released. When the locking arm is released, it is pulled into its engaged position with the gear 60 on the spool 50 by the spring 66. The hand grip 128 is also released at this time to allow the locking arm 120 to be pulled back into engagement with the spool 104 by the spring 124.

With the lift assembly 28 at its desired elevation, and the locking arms 62 and 120 in their engaged positions, the exercise device is ready to be used.

Although the above description relates to moving the lift assembly up to a desired elevation for exercise, the assembly can also be moved down. As was the case for moving the assembly up, both the locking arms 62 and 120 must be placed in their disengaged positions to move it down. As the assembly 28 is pushed down, the cable 54 is wound onto the spool 50 as the spool 50 is rotated by the spring 65 contained within. Such downward movement, therefore, shortens that portion of the cable 54 that extends from the spool 50 to the pulley 56. As the lift assembly is moving down, the weight 80 and stop block 88 are pulled up along the frame member 18*c* by means of their associated cables. Upward movement of the stop block pushes the stop 90 up along the frame member 18*c*, thereby unwinding the lower cable 110 from the pulley section 106 and winding the cable 114 onto the pulley section 108.

After the lift assembly has been moved down to its desired elevation, the locking arms 62 and 120 are released so that they return to their engaged positions.

As was mentioned above, a key feature of this invention is that the starting position of the lift assembly 28 can be at any elevation on the frame. For example, if desired, the lift assembly can be positioned at the floor. This is made possible by the unique design of the cage 30, which has a horizontal cross section sufficient to enable it to move down around the outside of the weights 22.

Turning again to FIG. 1, the lift assembly 28 is shown at one desired starting elevation for exercise with both of the locking arms 62 and 120 in their engaged positions. As is described below in detail, the lift assembly 28 can be raised by exerting a solely horizontal force on the arms 32 in the vertical planes in which they are located, or by exerting a solely upward vertical force on the arms. Additionally, the lift assembly can be raised by exerting forces on the arms in the vertical plane in which the arms are located at any angle between an upward vertical force and a horizontal force.

A solely horizontal force can be exerted on the arms by either pushing the arms horizontally toward the frame or by pulling the arms horizontally away from the frame. As the arms move horizontally, the cable 92 attached to the arm 32*a* and the cable 100 attached to the arm 32*b* are pulled through their respective rollers 96 and horizontally along the cage. Such horizontal movement of the cables 92 and 100 pulls the stop block 88 up against the stop 90, which is locked against upward movement on the frame member 18*c* by means of the cable 110 being attached to the pulley 104 which is locked. For example, the stop cannot move up because the length of the lower cable 110 connected between the stop 90 and the spool section 106 of the spool 104 is fixed by locking the spool against rotation. Since the cables 92 and 100 have a fixed length, pulling them horizontally along the cage causes the lift assembly 28 to move vertically upward on the frame the same distance that the arms are moved horizontally.

As the lift assembly moves up, the spool 50 and the arms 32*a* and 32*b* move up with it. Since the spool 50 is locked against rotation, the end of the cable 54 attached to the spool 50 is also pulled up. The upward force on the cable 54 is transmitted to the lift block assembly 52, thereby causing the lifting block 68 and the associated weights above the selector pin 78 to move up. The upward movement of the lifting block assembly 52 provides the resistance force against movement of the arms 32 and, hence, provides exercise to the individual moving the arms horizontally. Therefore, a person can use the exercise device 10 for any exercise that requires either a pushing or a pulling motion and such pushing or pulling motions can be accomplished by using either the arms or the legs. For example, when the legs are used, the feet can be placed against the exercise pad 48, and the lifting arms can be pushed horizontally by a force applied to the pad.

As an alternative to providing a directly horizontal force on the arms, a person desiring to exercise using the exercising device 10 can exert a force on the arms in a solely vertical direction to raise the lift assembly. Such a vertical force can be provided by either pushing the arms straight up from underneath or by pulling the arms up from above.

As was the case when the arms were moved horizontally, the upward vertical force on the arms causes the lift assembly to be raised, thereby lifting the lifting block 52 and the associated weights.

A key to the flexibility of using the exercise device 10 is that the lift assembly 28 can be moved upwardly, either by exerting a horizontal or vertical force on the arms. Additionally, however, a combination of such a horizontal force and vertical force can be used. For example, the person doing the exercise can exert a force on the arms at any angle between an upward vertical force and a horizontal force to raise the lift assembly against the resistance force provided by the weights. For instance, rowing exercises can be done on the device by pulling the arms upwardly at any angle between vertical and horizontal, or by pushing the arms at any angle between vertical and horizontal. Additionally, bench press exercises can be done by pushing the arms straight up, or by pushing them up at any other desired angle.

When the exercise device 10 is used for exercise by raising and lowering the lift assembly 28, as described above, the cable 132 attached to the pull bar 130 winds and unwinds from the spool 138 as the lifting block assembly 52 moves up and down. For example, when the lift block assembly moves up, the spool 138 is rotated by means of the spring contained therein to keep the slack out of the cable 132 on the bar 130. When the lift block assembly moves down, the cable 132 is unwound from the spool 138. Furthermore, when the lift block assembly is at rest on the stack of the weights, as is shown in FIG. 1, the cable 132 is in its fully extended position.

When it is desired to use the pull bar 130 for exercise, the locking arm 62 is disengaged from the spool 50 and pinned in its disengaged position. As the bar 130 is pulled down by the person doing the exercise, the lifting block assembly 52 and weights attached thereto are pulled up. Since this action tends to shorten the cable 54, the spool 50 rotates by means of the internal spring 65 to take up the slack in the cable 54. When the bar is returned to its initial position after being pulled down, the cable 54 unwinds from the spool 50.

As can be seen from the description of the exercise device 10 provided in accordance with this invention, it is extremely versatile and allows the individual to conduct many exercises by pushing and pulling motions at various angles so that a substantially complete exercise program can be accomplished with this single device.

Although only a single pull bar 130 is provided in the illustrated embodiment, two or more such pull bars can be provided connected to the weights by pulley and cable arrangements similar to those that connect the bar 130. Alternatively, no such pull bar arrangement need be provided, if desired.

The above description of a preferred embodiment of the exercise device provided in accordance with practice of this invention is for illustrative purposes. Because of variations which will be apparent to those skilled in the art, the present invention is not intended to be limited to the particular embodiments described above. The scope of the invention is defined in the following claims.

What is claimed is:

1. An exercise device comprising:

(a) a frame;

(b) a lift assembly slidably mounted on the frame for generally vertical up and down movement along the height of the frame;

(c) at least one elongated lifting arm mounted on the lift assembly capable of vertical movement with and horizontal movement along the lift assembly;

(d) resistance means interconnected with the frame and operatively connected to said lifting assembly for providing a resistance force against vertical upward movement of the lift assembly and against horizontal movement of said elongated lifting arm; and (e) means connected between said elongated lifting arm and the frame for providing a force opposite to the resistance force when the elongated lifting arm is moved either vertically or horizontally in either direction along said lift assembly.

2. An exercise device as is claimed in claim 1 wherein the resistance means comprises a stack of weights mounted on the frame.

3. An exercise device as is claimed in claim 2 wherein the lift assembly comprises a cage open at its top and bottom having a sufficient horizontal cross section so that said cage can be moved up and down along the height of the frame around the outside of the stack of weights.

4. An exercise device as is claimed in claim 1 wherein two elongated lifting arms are slidably mounted on the lift assembly, the first such elongated lifting arm being on one side of the lift assembly and the second such elongated lifting arm being horizontally spaced apart from the first arm on the opposite side of the lift assembly.

5. An exercise device comprising:

(a) a frame;

(b) a plurality of weights stacked one above the other on the frame;

(c) a lift assembly slidably mounted on the frame for vertical up and down movement along the height of the frame, the lift assembly comprising:

(i) a cage open at the top and bottom having a sufficient horizontal cross section so that the cage can be moved up and down around the outside of the stack of weights;

(ii) a first elongated lifting arm extending horizontally along one side of the cage mounted to the cage for horizontal sliding movement along the side of and vertical movement with the cage; and (iii) a second elongated lifting arm extending horizontally along the opposite side of the cage mounted to the cage for horizontal sliding movement along the side of and vertical movement with the cage;

(d) means on the frame coupling a selected number of the weights to the lift assembly to thereby provide a resistance force to vertical upward movement of the lift assembly and against horizontal movement of said elongated lifting arms; and (e) means on the frame for providing a force opposite to the resistance force when the first and second elongated arms are moved horizontally in the same direction along the sides of the cage.

6. An exercise device as is claimed in claim 5 wherein the coupling means comprises:

(a) a rotatable spool fixedly connected to the lift assembly cage;

(b) a lifting block assembly capable of being connected to a selected number of the weights and slidably mounted on the frame for vertical up and down movement along the height of the frame;

(c) a lift cable connected between the rotatable spool and the top of the lifting block assembly; and (d) locking means that, when in an engaged position, lock the spool against rotation to thereby fix the length of that portion of the lift cable connected between the spool and the lifting block assembly for coupling the resistance means to the lift assembly, wherein when said locking means is in its engaged position and the lifting block assembly is connected to a selected number of weights, upward vertical movement of the lift assembly causes the lifting block assembly and the selected weights connected thereto to move upwardly, thereby providing a resistance force to upward movement of said lift assembly.

7. An exercise device as is claimed in claim 6 wherein the spool locking means comprises:

(a) a circular gear mounted on one end of the rotatable spool; and (b) a locking arm movably mounted on the cage having a plurality of teeth on its end adjacent the circular gear, the locking arm capable of being moved from a first position where the locking arm teeth are engaged with the circular gear, thereby locking the spool against rotation, to a second position where the locking arm teeth are disengaged from the circular gear for allowing the spool to rotate.

8. An exercise device as is claimed in claim 7 wherein the spool locking means additionally comprises a spring connected to the locking arm for biasing the locking arm into its engaged position.

9. An exercise device as is claimed in claim 6 additionally comprising a spring mounted in the rotatable spool for rotating the spool when the spool locking means is disengaged to thereby take up slack in the lift cable.

10. An exercise device as is claimed in claim 5 wherein said means on the frame for providing the force opposite to the resistance force comprises:

(a) a stop slidably mounted on a vertically extending frame member;

(b) means for locking the stop in position on the vertically extending frame member against upward vertical movement;

(c) a stop block slidably mounted on the vertically extending frame member below the stop;

(d) a pair of pulleys mounted on the frame above the stop;

(e) a first cable connected on one end to one side of the top of the stop block, extending upwardly from the stop block through the first one of the pulleys and connected at its other end to the first elongated arm, and a second cable connected on one end to the other side of the top of the stop block, extending upwardly from the stop block through the second one of the pulleys and connected at its other end to the second elongated arm; and (f) a first guide means on the lift assembly associated with the first elongated arm for guiding the first cable horizontally along the cage, and a second guide means on the lift assembly associated with the second elongated arm for guiding the second cable horizontally along the cage when the second arm is moved horizontally along the cage, wherein when the stop is locked on the frame member against upward vertical movement, such horizontal movement of the first and second cables pulls the stop block up against the stop, thereby causing the lift assembly to move vertically upwardly on the frame about the same distance that the first and second arms are moved horizontally.

11. An exercise device as is claimed in claim 10 wherein said stop locking means comprises:

(a) a rotatable stop spool comprising first and second spool sections connected to the frame below the stop;

(b) a lower cable connected on one end to the stop, extending downwardly from the stop and connected on its other end to the first spool section; and (c) means for locking the spool against rotation when said spool locking means is in an engaged position to thereby fix that portion of the length of the lower cable connected between the spool and the stop, and for allowing the spool to rotate when said spool locking means is in a disengaged position, wherein when said spool locking means is in its engaged position, the stop is locked on the frame member against upward vertical movement beyond the length of that portion of the lower cable extending between the stop and the spool.

12. An exercise device as is claimed in claim 11 wherein said stop locking means additionally comprises an upper cable connected on one end to the stop, the upper cable extending upwardly through a pulley mounted above the stop and extending downwardly from the pulley and connected on its other end to the second spool section, wherein when said stop spool locking means is in its engaged position the length of that portion of the upper cable connected between the stop and the second spool section is fixed to thereby lock the stop on the frame member against downward vertical movement beyond the length of that portion of the upper cable extending between the stop and the second spool section.

13. An exercise device as is claimed in claim 11 wherein the stop spool locking means additionally comprises:

(a) a circular gear mounted on one end of the stop spool; and (b) a locking arm movably mounted on the frame having a plurality of teeth on its end adjacent the circular gear, the locking arm capable of being moved from a first position where the locking arm teeth are engaged with the stop spool gear, thereby locking the stop spool against rotation, to a second position where the locking arm teeth are disengaged from the stop spool gear for allowing the stop spool to rotate.

14. An exercise device as is claimed in claim 13 wherein the stop spool locking means additionally comprises a spring connected to the locking arm for biasing the locking arm into its first position.

15. An exercise device as is claimed in claim 14 wherein the stop spool locking means additionally comprises a pull cable connected on one end to the locking arm for pulling the locking arm to its second position against the force exerted by the biasing spring, thereby disengaging the locking arm teeth from the stop spool gear.

16. An exercise device as is claimed in claim 11 wherein a spring mounted in the rotatable stop spool rotates the stop spool to take up slack in the lower cable when the stop spool locking arm is in its disengaged position.

17. An exercise device as is claimed in claim 5 additionally comprising means for counterbalancing the weight of the lift assembly so that substantially the entire resistance force to vertical upward movement of the lift assembly is provided by the selected number of weights when said selected number of weights are coupled to the lift assembly.

18. An exercise device as is claimed in claim 5 comprising means for providing a force opposite to the force provided by the selected number of weights when the weights are uncoupled from the lift assembly.

19. An exercise device as is claimed in claim 18 wherein such force-providing means includes a pull bar connected by cable and pulley means to said selected number of weights.

20. An exercise device comprising:

(a) a frame;

(b) resistance means mounted on the frame;

(c) a lift assembly slidably mounted on the frame for vertical up and down movement along the height of the frame, the lift assembly comprising:

(i) a cage open at the top and bottom having a sufficient horizontal cross section so that the cage can be moved up and down around the outside of said resistance means;

(ii) a first elongated lifting arm extending horizontally along one side of the cage mounted to the cage for horizontal sliding movement along the side of and vertical movement with the cage; and (iii) a second elongated lifting arm extending horizontally along the opposite side of the cage mounted to the cage for horizontal sliding movement along the side of and vertical movement with the cage;

(d) means on the frame for coupling and uncoupling the resistance means from the lift assembly so that when the resistance means is coupled to the lift assembly, said resistance means provides a resistance force to vertical upward movement of the lift assembly and against horizontal movement of said elongated lifting arms; and (e) means on the frame for providing a force opposite to the resistance force when the first and second elongated arms are moved horizontally in the same direction along the sides of the cage and the resistance means is coupled to the lift assembly.

21. An exercise device as is claimed in claim 20 wherein the resistance means comprises a stack of weights.

22. An exercise device as is claimed in claim 21 wherein the coupling and uncoupling means comprises:

(a) a rotatable spool fixedly connected to the lift assembly cage;

(b) a lifting block assembly capable of being connected to a selected number of the weights and slidably mounted on the frame for vertical up and down movement along the height of the frame;

(c) a lift cable connected between the rotatable spool and the top of the lifting block assembly; and (d) locking means that, when in an engaged position, locks the spool against rotation to thereby fix the length of that portion of the lift cable connected between the spool and the lifting block assembly for coupling the resistance means to the lift assembly and, when in a disengaged position, allows the spool to rotate, thereby uncoupling the resistance means from the lift assembly, wherein when said locking means is in its engaged position and the lifting block assembly is connected to a selected number of weights, upward vertical movement of the lift assembly causes the lifting block assembly and the selected weights connected thereto to move upwardly, thereby providing a resistance force to upward movement of said lift assembly.

23. An exercise device as is claimed in claim 22 wherein the spool locking means comprises:

(a) a circular gear mounted on one end of the spool; and (b) a locking arm movably mounted on the cage having a plurality of teeth on its end adjacent the circular gear, the locking arm capable of being moved from a first position where the locking arm teeth are engaged with the circular gear, thereby locking the spool against rotation to a second position where the locking arm teeth are disengaged from the circular gear for allowing the spool to rotate.

24. An exercise device as is claimed in claim 23 wherein the spool locking means additionally comprises a spring connected to the locking arm for biasing the locking arm into its engaged position.

25. An exercise device as is claimed in claim 22 additionally comprising a spring mounted in the spool for rotating the spool when the locking means is in its disengaged position to thereby take up slack in the lift cable.

26. An exercise device as is claimed in claim 20 wherein said means on the frame for providing the force opposite to the resistance force comprises:

(a) a stop slidably mounted on a vertically extending frame member;

(b) means for locking the stop in position on the vertically extending frame member against upward vertical movement;

(c) a stop block slidably mounted on the vertically extending frame member below the stop;

(d) a pair of pulleys mounted on the frame above the stop;

(e) a first cable connected on one end to one side of the top of the stop block, extending upwardly from the stop block through the first one of the pulleys and connected at its other end to the first elongated arm, and a second cable connected on one end to the other side of the top of the stop block, extending upwardly from the stop block through the second one of the pulleys and connected at its other end to the second elongated arm; and (f) a first guide means on the lift assembly associated with the first elongated arm for guiding the first cable horizontally along the cage when the first arm is moved horizontally along the cage, and a second guide means on the lift assembly associated with the second elongated arm for guiding the second cable horizontally along the cage when the second arm is moved horizontally along the cage, wherein when the stop is locked on the frame member against upward vertical movement, such horizontal movement of the first and second cables pulls the stop block up against the stop, thereby causing the lift assembly to move vertically upwardly on the frame about the same distance that the first and second arms are moved horizontally.

27. An exercise device as is claimed in claim 26 wherein said stop locking means comprises:

(a) a rotatable stop spool comprising first and second spool sections connected to the frame below the stop;

(b) a lower cable connected on one end to the stop, extending downwardly from the stop and connected on its other end to the first spool section; and (c) means for locking the spool against rotation when said spool locking means is in an engaged position to thereby fix that portion of the length of the lower cable connected between the spool and the stop and for allowing the first spool to rotate when said spool locking means is in a disengaged position, wherein when said spool locking means is in its engaged position, the stop is locked on the frame member against upward vertical movement beyond the length of that portion of the cable extending between the stop and the spool.

28. An exercise device as is claimed in claim 27 wherein said stop locking means additionally comprises an upper cable connected on one end to the stop, the upper cable extending upwardly through a pulley mounted above the stop and extending downwardly from the pulley and connected on its other end to the second spool section, wherein when said spool locking means is in its first position the length of that portion of the upper cable connected between the stop and the second spool section is fixed to thereby lock the stop on the frame member against downward vertical movement beyond the length of that portion of the upper cable extending between the stop and the second spool section.

29. An exercise device as is claimed in claim 27 wherein the stop spool locking means additionally comprises:

(a) a circular gear mounted on one end of the stop spool; and (b) a locking arm movably mounted on the frame having a plurality of teeth on its end adjacent the circular gear, the locking arm capable of being moved from a first position where the locking arm teeth are engaged with the stop spool gear, thereby locking the stop spool against rotation, to a second position where the locking arm teeth are disengaged from the stop spool gear for allowing the stop spool to rotate.

30. An exercise device as is claimed in claim 29 wherein the stop spool locking means additionally comprises a spring connected to the locking arm for biasing the locking arm into its first position.

31. An exercise device as is claimed in claim 30 wherein the stop spool locking means additionally comprises a pull cable connected on one end to the locking arm for pulling the locking arm to its second position against the force exerted by the biasing spring, thereby disengaging the gear locking arm teeth from the stop spool gear.

32. An exercise device as is claimed in claim 27 wherein a spring mounted in the rotatable stop spool rotates the stop spool to take up slack in the lower cable when the stop spool locking arm is in its disengaged position.

33. An exercise device as is claimed in claim 20 additionally comprising means for counterbalancing the weight of the lift assembly so that substantially the entire resistance force to vertical upward movement of the lift assembly is provided by the resistance means when said resistance means is coupled to the lift assembly.

34. An exercise device as is claimed in claim 20 comprising means for providing a force opposite to the force provided by the resistance means when said resistance means is uncoupled from the lift assembly.

35. An exercise device as is claimed in claim 34 wherein such force-providing means includes a pull bar connected by cable and pulley means to said resistance means.

* * * * *